United States Patent [19]

Manderla

[11] Patent Number: 4,514,940

[45] Date of Patent: May 7, 1985

[54] SHORING SYSTEM

[75] Inventor: Henry J. Manderla, Burlington, Canada

[73] Assignee: Anthes Equipment Limited, Mississauga, Canada

[21] Appl. No.: 365,321

[22] Filed: Apr. 5, 1982

[30] Foreign Application Priority Data

Feb. 25, 1982 [CA] Canada ..... 397031

[51] Int. Cl.[3] ..... E04D 15/00; E04H 12/00

[52] U.S. Cl. ..... 52/126.1; 52/637; 52/646; 52/648; 182/179; 211/191; 403/49

[58] Field of Search ..... 52/126.3, 648, 657, 52/656, 721, 637, 645, 646, 126.1; 403/49, 292, 298; 182/178, 179; 211/182, 189, 191; 248/158, 218.4, 235

[56] References Cited

U.S. PATENT DOCUMENTS

| | | | |
|---|---|---|---|
| 420,724 | 4/1890 | Hussy | 52/657 |
| 2,990,203 | 6/1961 | Grover et al. | 182/179 |
| 3,129,917 | 4/1964 | Huggins | 248/218.4 |
| 3,305,981 | 2/1967 | Biggs et al. | 52/721 |
| 3,346,283 | 10/1967 | Squire | 403/298 |
| 3,423,898 | 1/1969 | Tracy et al. | 52/665 |
| 3,565,465 | 2/1971 | Wemyss | 403/292 |
| 3,726,414 | 4/1973 | Konstant | 211/191 |
| 3,730,572 | 5/1973 | Ballou | 403/49 |
| 3,845,601 | 11/1974 | Kostecky | 52/656 |
| 3,867,043 | 2/1975 | Plough | 403/49 |
| 4,140,414 | 2/1979 | Buttaereit | 403/49 |
| 4,369,859 | 1/1983 | Smits | 182/179 |
| 4,426,171 | 1/1984 | Layher | 403/49 |
| 4,462,197 | 1/1984 | D'Alessio et al. | 52/637 |

FOREIGN PATENT DOCUMENTS

| | | | |
|---|---|---|---|
| 499365 | 1/1954 | Canada | 52/637 |
| 629089 | 10/1961 | Canada | 52/655 |
| 725518 | 1/1966 | Canada . | |
| 755992 | 4/1967 | Canada . | |
| 855598 | 11/1970 | Canada . | |
| 1055991 | 6/1979 | Canada . | |
| 1901880 | 7/1969 | Fed. Rep. of Germany | 182/179 |
| 143488 | 8/1980 | Fed. Rep. of Germany | 182/178 |
| 895091 | 1/1945 | France | 403/292 |
| 2352194 | 1/1978 | France | 403/49 |
| 158241 | 10/1978 | Netherlands | 52/721 |
| 1201912 | 8/1970 | United Kingdom . | |
| 2066341 | 7/1981 | United Kingdom | 182/179 |
| 42243 | 12/1959 | Yugoslavia | 52/655 |

OTHER PUBLICATIONS

"Interform Variable Width Aluminum Frame Shoring System", Patent Scaffolding Co.

"The New Aluma Vertical Shoring System", Aluma Systems.

*Primary Examiner*—John E. Murtagh

*Assistant Examiner*—Andrew Joseph Rudy

*Attorney, Agent, or Firm*—Cushman, Darby & Cushman

[57] ABSTRACT

The invention relates to a shoring system which comprises tubular end frame members and at least horizontal connecting members supported by gusset members which are detachably connected to the horizontal as well as to the upright members.

3 Claims, 18 Drawing Figures

SHORING SYSTEM

This invention relates to a shoring system for use in the building industry. Many types of shoring systems are known formed from various materials such as e.g. wood or steel. Basically, the systems of steel are constituted by pairs of mutually opposed upright members, connected together by a plurality of vertically spaced horizontal members and diagonally extending bracing members, all such members being welded together to form a frame. Pairs of such frames are then connected together by cross-braces to form a support structure for plywood panels adapted to receive poured concrete thereon. The frames, therefore, are extremely heavy to handle and, due to the welded connections, cannot be knocked-down for easy shipment from one site to another, nor overseas for export markets.

For instance, from Canadian Specification No. 725,518 which issued on Jan. 11, 1966, to Donald B. Moritz, it is known to constitute scaffolding from a mutually opposed pair of tubular metal upright end frames which are detachably connected together by cross-braces. Each end frame is constituted by a pair of upright members, upper and lower horizontal members welded thereto, a median upright member welded to said upper and lower horizontal members, and a plurality of sub-horizontal members each welded at one end to the median member and at the other to an adjacent upright member.

In Canadian Specification No. 755,992 which issued to Robert K. Squire on Apr. 4, 1967, it is known to constitute shoring scaffolding from mutually opposed pairs of tubular metal upright end frames which are connected together by cross-struts which are welded thereto. Each end frame is constituted by a pair of upright members, a pair of upper and lower horizontal members welded thereto as well as a pair of diagonally extending cross-struts also welded thereo.

Canadian Specification No. 855,598 which issued on Nov. 10, 1970 to Fred C. Kosmach et al is entitled "Knockdown Scaffolding" yet it is constituted by mutually opposed pairs of tubular upright end frames which are detachably secured together by diagonally extending metal cross-braces. Each frame is constituted by a pair of metal upright tubular members to which vertically spaced horizontal cross-struts are welded. A similar arrangement is also shown in Canadian Specification No. 1,055,991 which issued to Ronald G. Morris on June 5, 1979. Hence, the advent and introduction of aluminum products into the building industry has pointed to the possibility of forming the above-mentioned frames from such material thereby considerably reducing their weight besides overcoming the other disadvantages encountered by the use of steel members.

The invention is illustrated, by way of example, in the accompanying drawings in which.

Figure 16B:
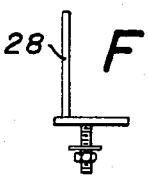
Figure 16A:
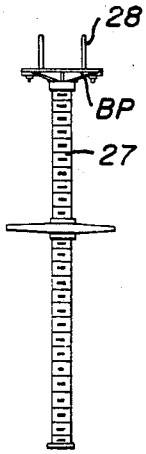
Figure 16C:
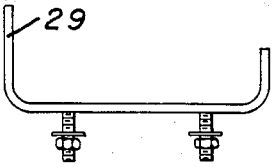

FIGS. 16*a* to 16*c* are detail views of alternative members which can be used whereby the scaffold structure can be employed as is shown in FIG. 16*a*.

Figure 1:
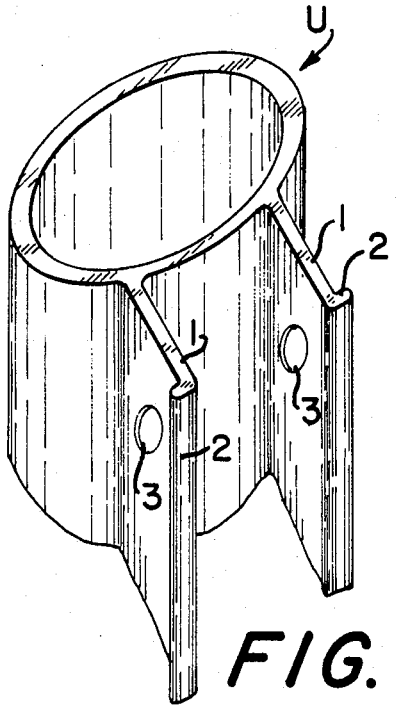
FIG. 1 is a fragmentary perspective view of an upright member.
Figure 2:
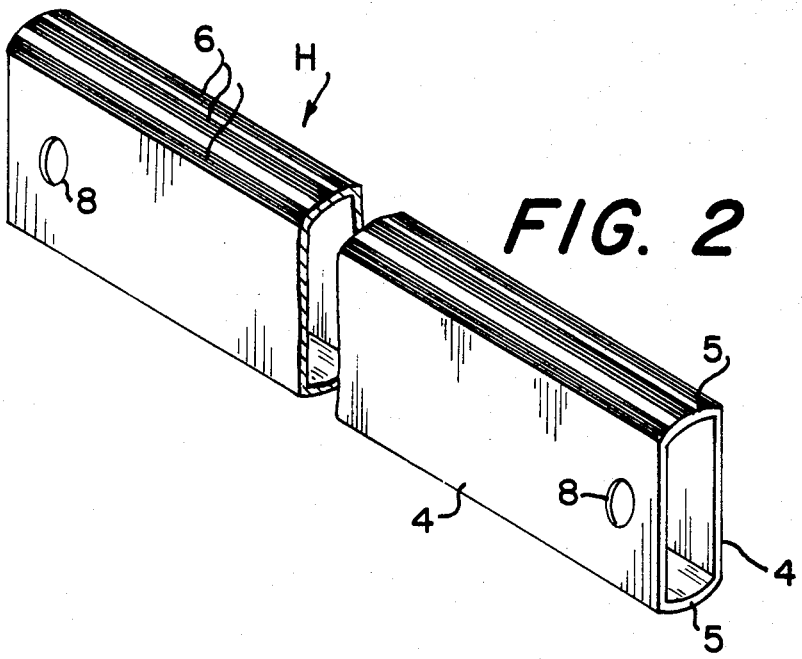
FIG. 2 is a fragmentary perspective view of a horizontal member.
Figure 3:
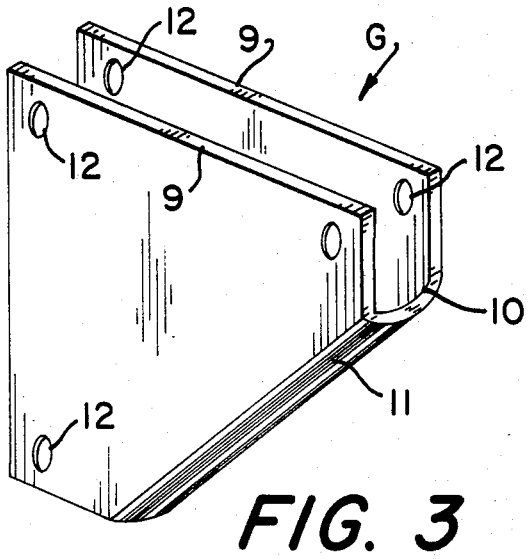
FIG. 3 is a perspective view of a gusset member.

Referring to the drawings, and in particular to the FIGS. 1–3, the shoring system basically consists of three elements, upright members U shown in FIG. 1, horizontal members H shown in FIG. 2 and gusset members G shown in FIG. 3.

Figure 5:
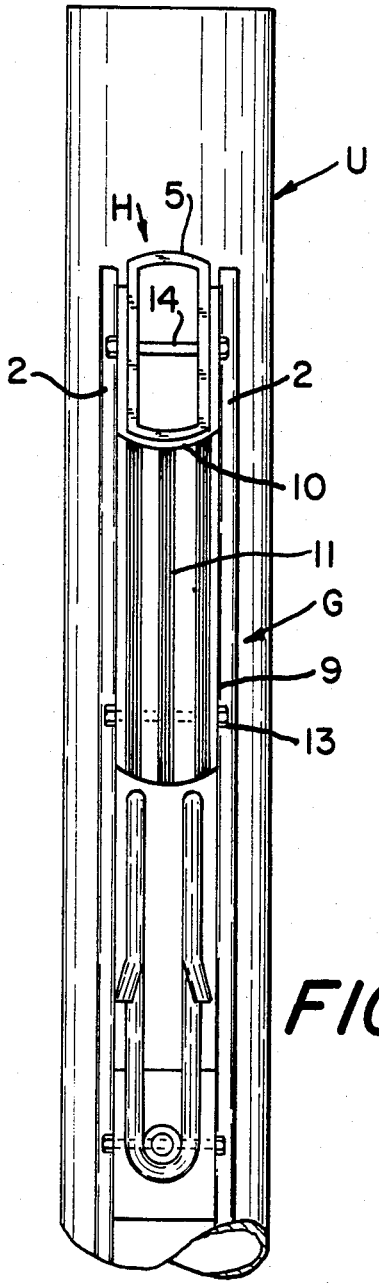
Figure 7:
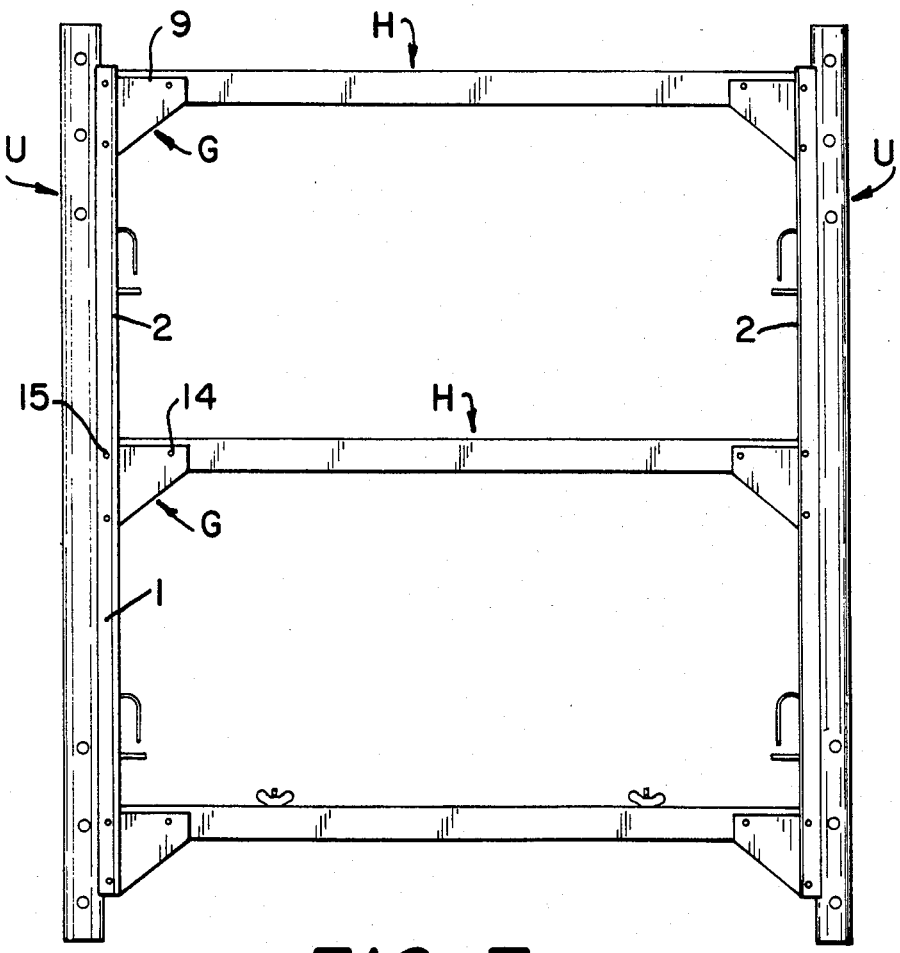
FIGS. 7–9 are end elevations of various vertically extending frames.

Each upright member U is preferably tubular and is provided with a pair of integral, mutually opposed projecting side cheeks or flanges 1 (see FIG. 1). The flanges 1 extend longitudinally at least partially throughout the upright members, as shown in FIG. 5 and FIG. 7. The free end of each flange is provided with a substantially radially extending and profiled stub flange 2. The flanges 1 are provided with a plurality of equivertically spaced holes 3.

Figure 6:
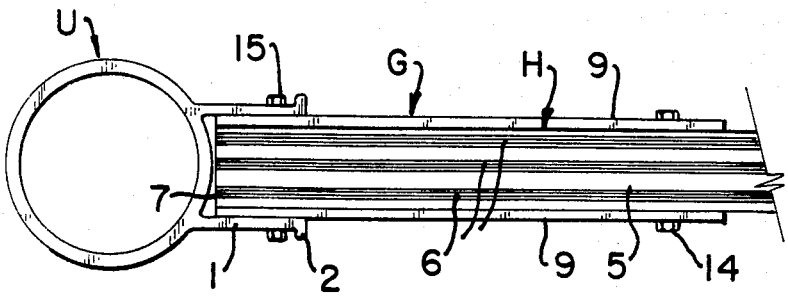

Each horizontal member H (see FIG. 2) is preferably hollow and is constituted by a pair of mutually opposed, substantially planar, side faces 4 connected together at their marginal side edges by convex surfaces 5, which are provided with a plurality of striations 6 which extend parallel with the central longitudinal axis of the horizontal member H. As will be seen from reference to FIG. 6, the end 7 of each horizontal member H extends normal to the central longitudinal axis of said member; however, said end may also have the curvature of that of the outer periphery of the upright member U. Each end of each horizontal member H is provided with a pair of spaced holes 8.

Each gusset member G (see FIG. 3) is provided with a pair of mutually opposed side faces 9 connected by an angularly arcuate lower surface 10 provided with a plurality of striations 11. Each member G is provided with corresponding pairs of holes 12.

Figure 4:
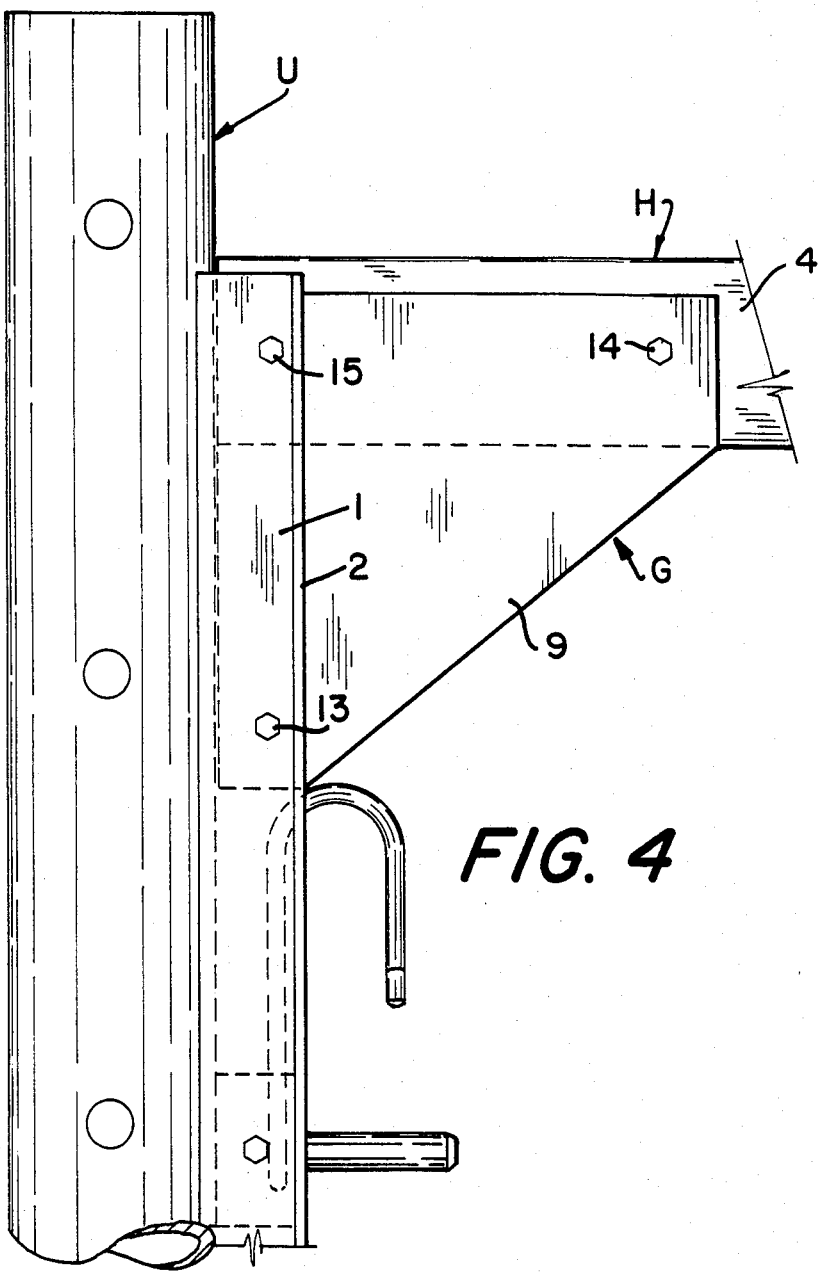
FIGS. 4–6 are, respectively, front, side and plan views of a portion of an assembled shoring system.

Additionally, each upright member U is provided with a plurality of vertically spaced holes 16, see FIG. 4.

To assemble the shoring system, a portion of one or more gusset members G is located between the cheeks 1 of an associated member U and is detachably secured thereto by bolts 13. A pair of such members U is then spaced apart by means of horizontal members H which are detachably connected to, and between, the side faces 4 of the gusset members G by bolts 14 and bolts 15. Whereas the bolts 14 pass through the side faces 9 of the gusset member G and through the side faces 4 of each horizontal member H, said bolts 15 additionally pass through the side cheeks 1 of member U. Thus frames, each constituted by a mutually opposed pair of upright members U connected together by a plurality of vertically spaced horizontal members H are provided, each end of each said member H being supported by, and detachably connected to a gusset member G as well as being detachably secured to an associated upright member U.

Figure 8:
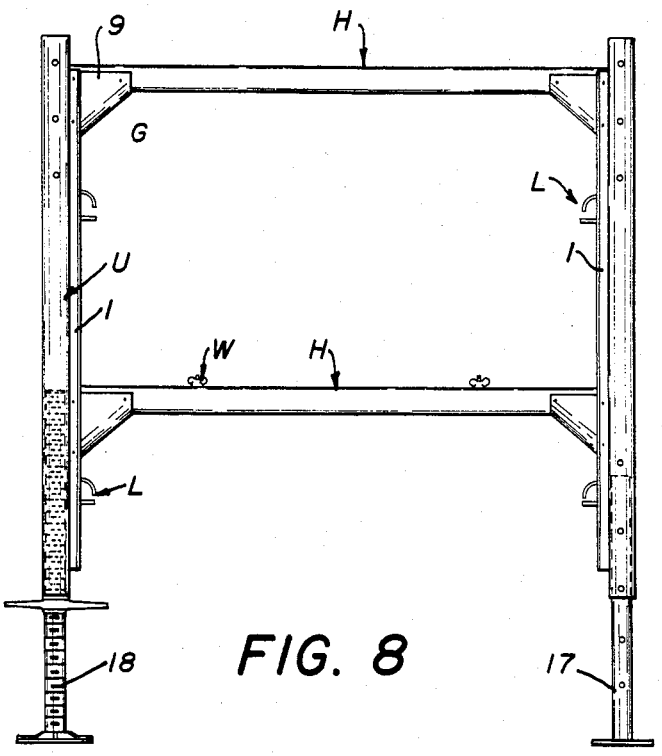
Figure 9:
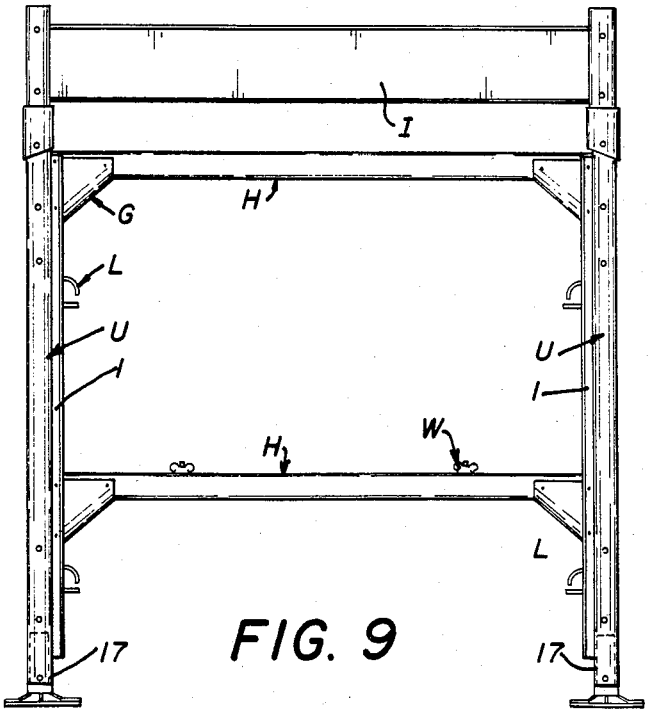

The lower end of each upright member U is provided with a vertically adjustable leg and pedestal foot, indicated generally at 17 in the right hand member U in FIG. 8 and both members U in FIG. 9 or an adjustable screw jack with pedestal foot, such as that indicated generally at 18 in FIG. 8 in the left-hand member U, the question of whether integers 17 or 18 should be used depending upon the required height of the scaffold structure.

If desired, the uppermost horizontal member H can be strengthened (in order to carry heavier loads) by means of an I-beam such as that shown in FIG. 9 and indicated at I.

Figure 10:
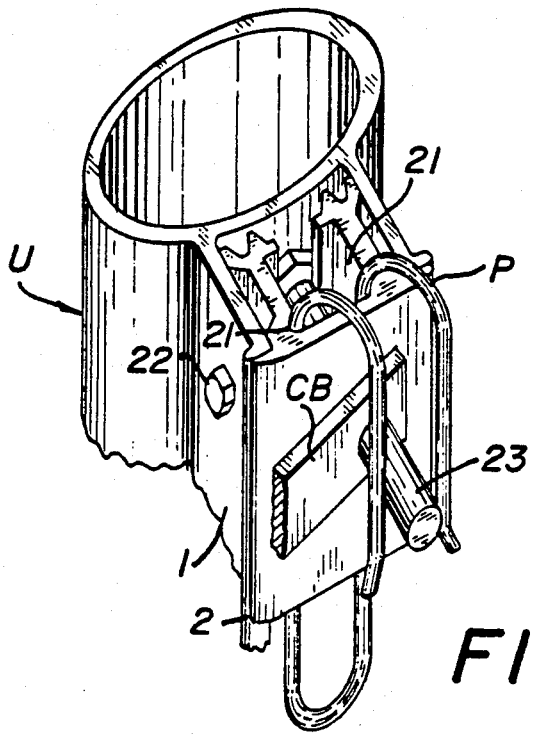
FIG. 10 is a detail view of one form of gravity lock and FIG. 11 is a plan view thereof.
Figure 11:
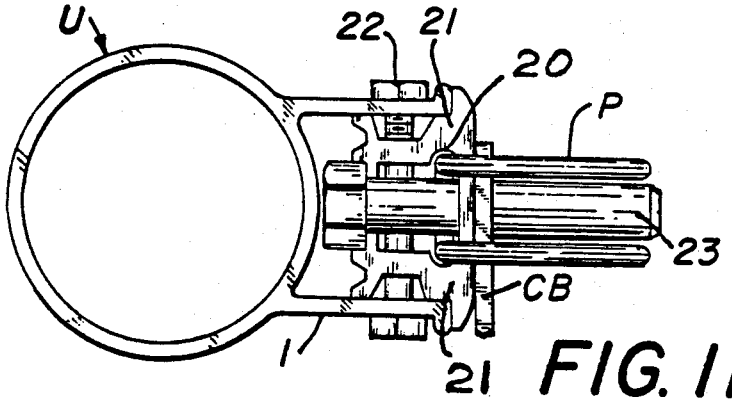
Figure 12:
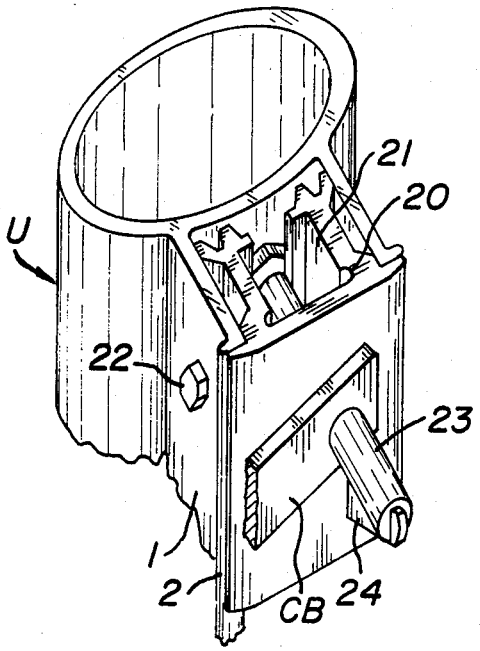
FIG. 12 is a detail view of an alternative form of gravity lock.

Each upright member U is provided with a pair of gravity locks, indicated generally at L (FIGS. 8 and 9) and which, generally, may be of the type described and claimed in copending Canadian Application No. 369,800 filed Jan. 30, 1981. Alternatively, they may be of the type shown in FIGS. 10 and 11 where, as will be seen, the gravity slider P is vertically slidable in the guideway 20 of a housing 21 which, in turn, is vertically slidable between the pair of side flanges 1 of the upright member U unless retained at the desired height by means of a bolt 22 passing through said flanges 1 and said housing 21. A locking bolt 23 extends from the front face of the housing 21 whereby said bolt and the slider P cooperate to retain the apertured end of a cross-brace CB on said locking bolt 23. Alternatively, the gravity locks L may take the form of that shown in FIG. 12 where the slider P is omitted and where the bolt 23 is provided with a pivoted retaining latch 24 which serves to retain the cross-braces CB on the bolt 23.

The cross-braces CB connect and space apart each pair of frames. Such cross-braces, may also connect the frames horizontally through the use of wing-bolts W located on the upper surface of the horizontal members H.

Figure 13:
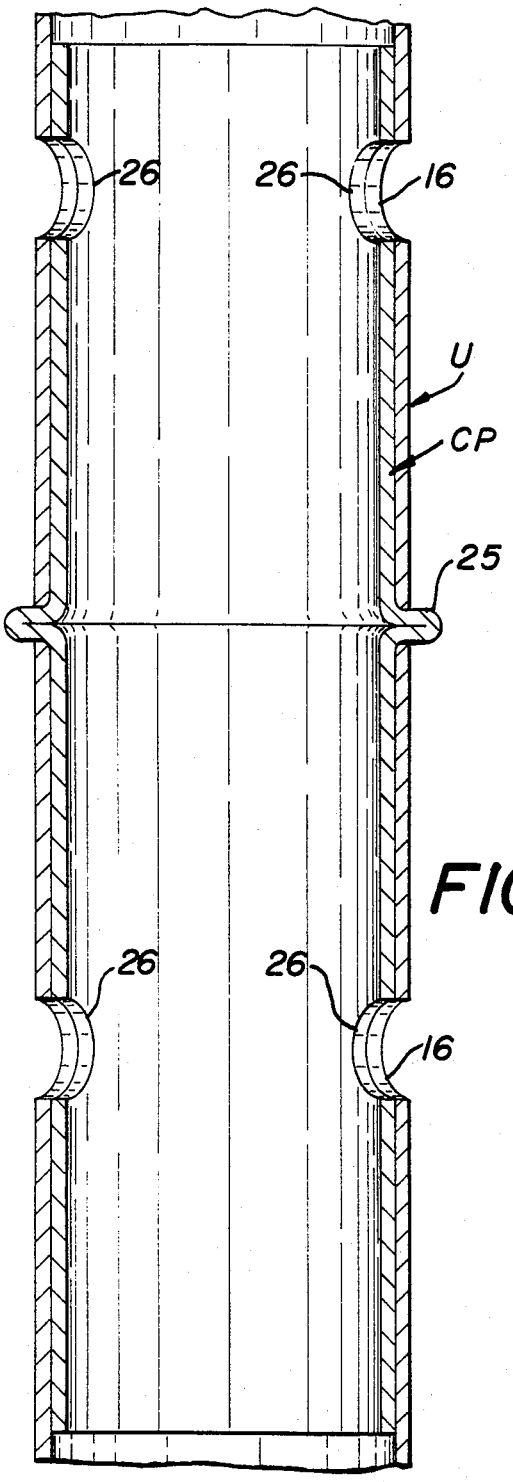
FIG. 13 is a longitudinal section of a coupling pin.
Figure 14:
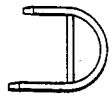
FIG. 14 is a detail view.

If the height of the project demands it, stacking or coupling pins are introduced into the open and upper ends of the lowermost pair of frames so as to project therefrom and further or extension frames placed over said pins, the ends of the uprights of said frames preferably being bolted or otherwise secured such as, e.g. by the use of the U-shaped pins shown in FIG. 14 to said pins. Although coupling pins of known type i.e. each constituted by a pair of cylindrical end pieces swaged to a central collar of larger diameter, may be used, they are preferably of the type shown in section in FIG. 13. These pins CP are formed from an extruded aluminum member which is provided with a peripherally extending bead 25 and diametrically located holes 26. The bead 25 is formed by axially compressing the tube forming said pin and serves as a seating both for the upper end of an upright of a lowermost frame as well as for the lower end of the next axially aligned upper frame so as to ensure that the terminal end faces of said ends will have the utmost surface contact with the bead as possible. The diameter of the pin CP extending from the bead to the end of the pin are of a diameter substantially equal to the inner diameter of each upright member U.

It will be noted from reference to FIG. 13 that the upper portion of pin CP i.e. that portion extending upwardly from the bead 25 is shorter than the lower portion. This arrangement is quite deliberate because the erection of a pair of vertically aligned frames is much quicker by ensuring that the longer end of a pin CP is inserted firstly into a frame rather than the shorter end.

The provision of the stub flanges 2 on each upright member U is so that the nuts and headed bolts 13 and 15 will engage and abut said flanges 2 and will not turn simultaneously with their fellow screwed integers.

If the height of the scaffold structure is still insufficient, extension staffs (not shown but of known design) can be inserted in the upper ends of the uppermost frames and threaded jackscrews 27 can be inserted either in the upper ends of said uppermost frames or in the uppermost ends of the extension staffs if employed.

Figure 15:
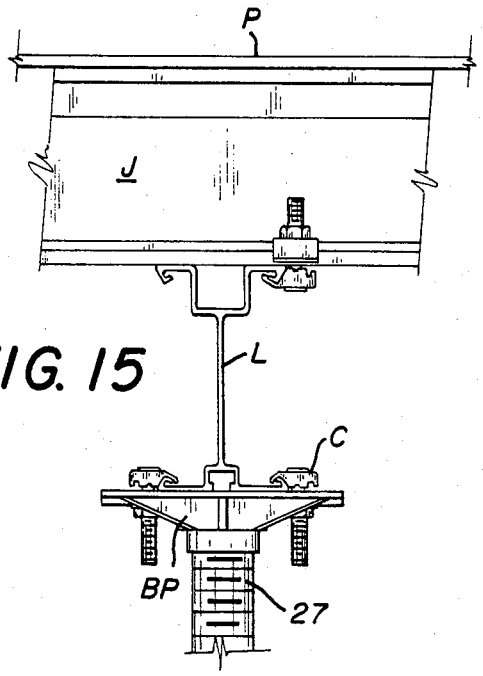
FIG. 15 is a detail view of one type of use of the scaffold structure.

A bearing plate BP, such as the types shown in copending Canadian Application No. 369,662 filed Jan. 29, 1981, is secured to the upper end of the jackscrew 27 as is shown in FIG. 15 of the accompanying drawings.

A ledger or stringer L of the types described and illustrated in British Pat. No. 1,501,783 which issued on Feb. 22, 1978 or copending Canadian Application No. 368,473 filed on Jan. 14, 1981 is detachably secured to the bearing plates BP by means of the clamps C which are described and claimed in copending Canadian Application No. 368,630 filed on Jan. 15, 1981. The upper ends of said ledgers or stringers L are also detachably secured to transversely extending joists J which are again either of the type described and claimed in either the above-mentioned British Patent or the said Canadian Application No. 368,473.

Alternatively, the bearing plate PB may carry a pair of L-shaped clamps 28 of the type shown in FIG. **16*b* (jointly forming a U-head accessory as is shown in FIG. 16*a*) between which a joist J is clamped, or the U-shaped accessory 29 which is shown in FIG. 16*c* and which has the same purpose as the clamps 28**.

Plywood panels PY (FIG. 15) can then be nailed to the joists in order to support poured concrete in known manner.

From the above description, it will be appreciated that an extremely simple, efficient and lightweight shoring system can be formed from the various integers which are of high grade aluminum or of galvanized steel or a mixture of integers of either material.

I claim:

1. A shoring system including a plurality of vertically extending frames each including a pair of mutually opposed upright members each said upright member having a pair of spaced integral projecting side cheeks extending longitudinally at least partially throughout its associated upright member; at least a pair of mutually opposed gusset members each detachably secured to an upright member of said pair of mutually opposed upright members between said pair of spaced, integrally projecting side cheeks at a selectable location; and provided with a pair of mutually opposed side faces connected by an arcuate lower surface provided with striations extending along its longitudinal axis; at least one horizontally extending member opposite ends of which are supported by and detachably secured to said gussets, and the side cheeks, said horizontal member being constituted by a pair of mutually opposed substantially planar side faces connected at their upper and lower extremeties by convex surfaces at least one of which has a plurality of striations extending parallel with the central longitudinal axis of said horizontal member; and a lock, including a horizontally extending bolt, secured to each said pair of said vertical cheeks and adapted to receive and retain apertured cross-braces between horizontally spaced pairs of said frame members, said bolt receiving said cross-braces thereon.

2. A shoring system including a plurality of vertically extending frames each including a pair of mutually opposed upright members each said upright member having a pair of spaced integral projecting side cheeks extending longitudinally at least partially throughout its associated upright member; at least a pair of mutually opposed gusset members each detachably secured to an upright member of said pair of mutually opposed upright members between said pair of spaced, integrally projecting side cheeks at a selectable location; and provided with a pair of mutually opposed side faces connected by an arcuate lower surface provided with striations extending along its longitudinal axis; at least one horizontally extending member opposite ends of which are supported by and detachably secured to said gussets, and the side cheeks, said horizontal member being constituted by a pair of mutually opposed substantially planar side faces connected at their upper and lower extremeties by convex surfaces at least one of which has a plurality of striations extending parallel with the central longitudinal axis of said horizontal member; and a lock including a horizontally extending bolt pivotable with a latch and a vertically adjustable slider, secured to each said pair of said vertical cheeks and adapted to receive and retain apertured cross-braces between horizontally spaced pairs of said frame members said bolt receiving said cross-braces thereon, said slider cooperating with said bolt and said latch to retain said cross-braces on said bolt.

3. A shoring system including a plurality of vertically extending frames each including a pair of mutually opposed upright members each said upright member having a pair of spaced integral projecting side cheeks extending longitudinally at least partially throughout its associated upright member; at least a pair of mutually opposed gusset members each detachably secured to an upright member of said pair of mutually opposed upright members between said pair of spaced, integrally projecting side cheeks at a selectable location and each provided with a profiled stub flange; and provided with a pair of mutually opposed side faces connected by an arcuate lower surface provided with striations extending along its longitudinal axis; at least one horizontally extending member opposite ends of which are supported by and detachably secured to said gussets, and the side cheeks, said horizontal member being constituted by a pair of mutually opposed substantially planar side faces connected at their upper and lower extremeties by convex surfaces at least one of which has a plurality of striations extending parallel with the central longitudinal axis of said horizontal member; and a lock including a horizontally extending bolt pivotable with a latch and a vertically adjustable slider, secured to each said pair of said vertical cheeks and adapted to receive and retain apertured cross-braces between horizontally spaced pairs of said frame members, said bolt receiving said cross-braces thereon, said slider cooperating with said bolt and said latch to retain said cross-braces on said bolt; vertically aligned pairs of said frames being connected together by vertically axially extending tubular connecting pins each having a pair of oppositely disposed terminal ends with a peripherally extending bead therebetween located nearer one of said pair of ends than the remaining end of each said pair thereof, said bead serving as a means to limit the insertion of a said pin into the top of a lower vertical member and also serving as a seating for the lower end of an upper vertical member connected to said lower vertical member.

* * * * *